US007847673B2

(12) United States Patent
Scott

(10) Patent No.: US 7,847,673 B2
(45) Date of Patent: Dec. 7, 2010

(54) DUPLEX-ATTACHMENT OF CERAMIC DISK PTC TO SUBSTRATES

(75) Inventor: Thomas R. Scott, Beaverton, OR (US)

(73) Assignee: Xerox Corporation, Norwalk, CT (US)

( * ) Notice: Subject to any disclaimer, the term of this patent is extended or adjusted under 35 U.S.C. 154(b) by 601 days.

(21) Appl. No.: 11/975,229

(22) Filed: Oct. 18, 2007

(65) Prior Publication Data

US 2009/0102599 A1 Apr. 23, 2009

(51) Int. Cl.
*H01C 7/10* (2006.01)

(52) U.S. Cl. ..... 338/22 R; 338/315; 338/329

(58) Field of Classification Search ..... 338/22 R, 338/306, 315, 322, 329
See application file for complete search history.

(56) References Cited

U.S. PATENT DOCUMENTS 5,351,390 A * 10/1994 Yamada et al. ..... 29/612
5,777,541 A * 7/1998 Vekeman ..... 338/22 R
7,271,369 B2 * 9/2007 Li et al. ..... 219/505
2005/0030689 A1 * 2/2005 Toth et al. ..... 361/103

OTHER PUBLICATIONS

EPCOS. (Mar. 2006). EPCOS—PTC Thermistor Application Notes, Mar. 2006. Vertrieb Deutschland. EPCOS AG.

EPCOS. (Mar. 2006). EPCOS—PTC Thermistor General Technical Information, Mar. 2006. Vertrieb Deutschland. EPCOS AG.

EPCOS. (Mar. 2006). EPCOS—PTC Thermistor Mounting Instructions, Mar. 2006. Vertrieb Deutschland. EPCOS AG.

GE Sensing (2007) http://www.gesensing.com/thermometricsproducts/ptc.htm.

Stetron International (2007) http://www.stetron.com/other-products/thermistors-assemblies/ptc-thermistors/.

Sunlead/Victon Technology Electronic Co., Ltd. (2007) http://www.sunlead.com.tw/protuct.htm.

* cited by examiner

*Primary Examiner*—Kyung Lee
(74) *Attorney, Agent, or Firm*—Ronald E. Prass, Jr.; Prass LLP

(57) ABSTRACT

This is a ceramic disk PTC and heater assembly, and a method for attaching one to the other, the combination useful in the heating elements of solid ink printing apparatus. The ceramic disk PTC attachment method is made up of a low melting temperature solder and a high operating temperature adhesive. The solder attaches the disk to a substrate, and provides a low resistance electrical and thermal bond to the substrate. The adhesive is used to substantially completely encircle the solder, containing the solder when melted, and keeping the PTC attached when the solder is melted. The adhesive can also partially encircle the solder to a degree sufficient to substantially prevent substantial escape of molten solder from the attachment area.

11 Claims, 4 Drawing Sheets

DUPLEX-ATTACHMENT OF CERAMIC DISK PTC TO SUBSTRATES

This invention relates to PTC thermistors and, more specifically, to a novel PTC ceramic disk mounting structure and method.

BACKGROUND

PTC (positive temperature coefficient [of resistance]) thermistors are electrical components whose primary feature is that their resistance increases in a controlled fashion as the temperature increases above some threshold. A plotted graph of a PTC's resistance and temperature is commonly referred to as an R/T curve. The threshold temperature above which the PTC's resistance increases rapidly is referred to as the Currie Temperature, and exhibits a distinctive transition in the PTC's R/T curve. Before the Currie Temperature, the resistance may be unchanging, or even decline very slightly, but as the Curie temperature is exceeded, the slope of increasing resistance typically becomes very steep.

PTC thermistor devices in many physical configurations are well known in the art (see References below), and have several uses including: (1) as a temperature sensor, (2) as heating elements, and (3) as temperature regulation devices against over-temperature or over-current.

(1) As a temperature sensor—When either an NTC (negative temperature coefficient) or a PTC (positive temperature coefficient) thermistor is used as a temperature sensor, the local environment temperature affects the thermistor's electrical resistance characteristic which can then be monitored by another electronic circuit. NTC thermistors reduce in electrical resistance as temperature increases, and PTC thermistors increase in electrical resistance as temperature increases. A thermistor applied as a sensor may be used to detect whether a temperature limit in equipment, liquids, or other materials is exceeded. Thermistors used as sensors typically have the advantages of small dimensions, low cost, simple reliability, and high control accuracy.

(2) As heating elements—PTC thermistors have also been used in prior art directly as heaters. PTC thermistors are well suited to use as heating elements due to their specific property of increasing resistance as their temperature increases. This property tends to prevent PTC heaters from over-heating and may allow PTC thermistors in some heating applications to be used without other temperature control and regulating components, and some heating applications without requiring over-temperature protection devices. PTC thermistor heating elements have been used when space is a consideration, when high-reliability is desired, when a fail-safe design is required, and wherever measurement and regulating equipment as well as heating devices must be enclosed in small spaces.

(3) As protective devices against over-temperature or over-current—PTC thermistors may be used instead of thermal-cutoff-fuses or conventional current-fuses to protect against over-temperature conditions or over-current loads in motors or other electronic circuits, by placing the PTC electrically in series with the circuit that is to be protected. In an over-current condition, the increased current to the protected circuit causes increased heat dissipation in the PTC Thermistor, and as the PTC Thermistor's temperature increases, its resistance increases. As the PTCs resistance increases, the current to the protected circuit is reduced, which rapidly reduces the power dissipated in the protected circuit, potentially preventing an over-current condition in the protected circuit (eg.: motor or heater). PTC Thermistors thus are capable of limiting the power dissipation of the overall circuit by increasing their resistance, which reduces the current flowing in the protected system. Power dissipation is a product of the resistance times the square of the current, so reducing the current, a squared term, reduces the power dissipation faster than the increasing resistance can increase the power dissipated.

Thermal-cutoff-fuses may also be used for protection where an over-current condition causes over-temperature, or where a heater might be damaged if a power regulation system failure allows the heater to overheat, but PTC thermistors have several advantages over thermal fuses or current fuses. PTCs do not have to be replaced after elimination of the fault but can resume their protective function immediately upon removal of the overload condition, with some time allowed for the PTC to cool.

Because a PTC thermistor can recover from a momentary over-temperature condition, their protected temperature may be selected to be closer to normal operating temperatures without incurring serious consequences from nuisance trips. If a thermal cutoff fuse or current fuse reaches its fuse temperature or current, the fuse "opens" in a "destructive" manner and must be replaced, resulting in the intervention of a repair service call or product return. Because of this, destructive fuses will typically be selected at temperatures that allow larger temperature margins above the normal operating temperature. There are "bimetallic" thermal cutouts which also offer non-destructive operation, but these may be more expensive, may be slower to act due to packaging and size characteristics, and may require manual intervention, or cycling to a much lower temperature than the trip point, in order to be reset. In contrast to this, PTC thermistors can return to their initial resistance value immediately upon cooling below their Curie temperature, even after frequent heating and cooling cycles.

In some cases, the flat disk form of ceramic disk PTC thermistors allows them to have a large surface area of thermal bond with the protected system. This promotes improved thermal conductivity compared to a more conventional thermal fuse package in which the temperature-sensitive element is typically packaged in an enclosure with the fuse element more thermally isolated from the protected system. This improved thermal conductivity of ceramic disk PTC thermistors allows them to more closely and more quickly follow the temperature of the protected system, allowing faster and more accurate protection.

PTC thermistors of prior art are made of various materials, including both ceramic and polymer base substances with various doping additives which promote the PTC resistance effect.

The present invention relates specifically to PTC thermistors in the form of a ceramic disk approximately the size of a coin, with metalized opposing flat surfaces to which electrical connections can be attached. The resistance value in this device is measured between the opposing flat surfaces, the PTC resistance material being sandwiched between the two metalized flat surfaces.

The PTC effect typically relies upon a phase change in the structure of the composite resistance material, changing from a more crystalline structure to a more amorphous structure at what is known as the Curie temperature. This phase change characteristic is typically responsible for increasing the electrical resistance of the composite material. This phase change is also characterized by significant mechanical dimension changes, measured as the CTE (coefficient of thermal expansion) of the material. This CTE expansion is typically greatest above the Curie temperature where the material becomes more amorphous, and is less pronounced below the Curie temperature where the material is more crystalline in structure.

As a result of these CTE dimension changes, in prior art it has been recommended that large ceramic disk PTC devices suitable for high powered applications should not be attached to a substrate by soldering. Quoting an application note entitled "Mounting Instructions," from one PTC manufacturer:

> "... for applications involving frequent switching and high turn-on power. Soldering is not allowed for such applications in order to avoid operational failure ...". (Epcos, 2006c, p. 7)

This is at least partly because a solder chosen to have a melting temperature above the operating temperature of the protected system, would freeze into solid form well above the Curie temperature of the PTC, where the PTCs CTE changes are quite large. Then as the PTC and substrate are allowed to cool, the PTC and substrate would exhibit very different CTE changes while attached with a rigid frozen solder joint. The assembly would then come under severe shearing stresses and other stresses which typically will crack the PTC ceramic material, or cause a failure of the solder joint adhesion to one or both surfaces. Smaller PTC devices designed for low power operation may be effectively soldered by carefully following the manufacturers recommendations, and wires may be successfully soldered to the surface of larger high-powered PTC devices, because the soldered area can be quite small, which results in reduced CTE-induced stresses.

While ceramic disk PTC thermistors have several known uses, the novel ceramic disk PTC attachment structure and method of this invention will be described in reference to use in solid ink marking apparatus. This description is but one example of a use of this invention, provided as an example for clarity, and it is to be understood that the present invention can be used in any suitable system, both presently known and unknown to achieve some or all of the beneficial effects described in this example system. PTC thermistor uses that can benefit from this attachment method include usage as a sensor, as a heating element, or as protective devices against over-temperature or over-current, or with other ceramic electronic components where a mismatched CTE between the device and the substrate it is attached to might prevent the device from being soldered without the novel method described herein.

Solid Ink marking technology employs an ink material which remains in a solid form, technically "frozen" solid at room temperature, but when heated sufficiently changes phase from its frozen solid state to a melted liquid form which can then be manipulated in various ways as any liquid ink to form images on paper. Solid ink marking technology addresses key user requirements, expectations and human factor issues by how it works. Its excellent image creation method, simplicity, and ease of use set it apart from other printer marking methods. Because the ink material is frozen in a solid state at normal human-comfort room temperatures, the packaging and handling is simplified, being not prone to messy handling or spills, and requiring less complicated and wasteful packaging materials which would need to be recycled or disposed of. When the solid ink stick has all been melted and used for printing, there is no container or cartridge left behind in the printing system that must be removed and recycled or disposed of.

Moreover, Solid Ink offers remarkable print quality on the broadest range of print media including cardstock, envelopes and transparencies as well as recycled paper, coated or uncoated paper stocks, and custom page sizes. For example, solid ink printers can accommodate media from 16 lb. bond to over 80 lb cover cardstock. Laser printers vary and can be limited to 58 lb. paper stock. Wet inkjet printers generally require specially treated media which prevents the liquid ink from "bleeding" into the fibers of the paper which causes blurred images, unintended mixing of colors, as well as warping and wrinkling of the paper due to the fibers becoming unstable when wet. Solid ink printer marking does not require coated papers because it uses an ink that turns solid upon contact with the paper and is not subject to these effects. Coated papers for inkjet printing are not always available in a wide range of thicknesses, textures, colors and sizes, and may be more costly.

Solid ink printers are also easy to use and maintain. Ink loading is simple—each color has a unique shape-coded and numbered ink stick which ensures there is no mix up. The right color goes only in the right place and, because solid ink is solid, not wet or powdered, there is no mess. The only other consumable required in a solid ink printing system is a maintenance kit which takes less than a minute to replace, about once a year.

Solid ink has the critical property of remaining in solid form until heated to a very specific temperature whereupon it changes phase from solid to liquid then instantly changes back to solid when allowed to cool upon contact with the paper media. This required control of ink temperatures requires precision heating devices with suitable temperature monitoring, control, and over-temperature protection.

Solid ink is applied through a precise heated print head with tiny holes smaller than a human hair. It uses many ink nozzles jetting more than 30 million drops per second of melted liquid ink. Years of investment, research and experience have yielded multiple generations of inks and heated print heads that work together as a system.

The ink is jetted from the print head to a heated drum where it is maintained at the phase-change temperature of the ink, not liquid, but not fully solid, in a malleable state that ensures precise transfer to the paper. This reduces the amount of ink that can wick into the paper fibers and controls dot spread or image smearing or bleeding.

Precision temperature management is necessary for successful solid ink printing, and heaters may be controlled or protected by PTC thermistors.

More specifics on solid ink printing can be obtained from the public web site www.xerox.com which is incorporated by reference into this disclosure. (Xerox, 2007)

SUMMARY

The present PTC ceramic disk attachment method in an embodiment comprises an area of solder attachment smaller in diameter than the outside diameter of the PTC disk, the use of a low temperature solder that melts at a temperature at or below the selected Curie temperature of the PTC, and a high operating temperature adhesive that will remain resilient, applied around the perimeter of the PTC disk.

The resilient adhesive serves to keep the PTC attached to its substrate even if the solder melt temperature is exceeded, allowing the solder to melt into a liquid state. The resilient adhesive might be applied in any of a multitude of manners, including by silk-screening, liquid dispensing, sprayed with a mask, or applied in a tape film.

The solder may be applied as a solder-paste, and re-flowed with conventional IR (Infrared) reflow heating or another means (as is typical practice in electronic circuit board soldering), either before or after applying the adhesive.

The present embodiments provide a means to attach a ceramic disk electronic component to a substrate in which the respective materials have a mismatch in coefficient of thermal expansion (CTE) and significant temperature excursions are expected. Conventional prior art recommends such attachment by mechanical clamping, or by bonding with metal-filled (eg: Ag-filled) electrically conductive chemically-cured adhesive. (Epcos, 2006c, p. 7) These prior art methods are typically less thermally conductive than solder, reducing the critical thermal efficiency of the bond between the PTC and its substrate. The metal-filled chemically-cured conductive adhesive may be very hard and can exhibit similar CTE-induced shearing stresses that occur with soldering if the device will be exposed to wide temperature excursions. In particular, in a ceramic disk PTC as its temperature crosses and exceeds the PTC Curie temperature.

The present invention employs a low melt temperature solder, chosen to melt at or below the Curie temperature of the PTC, to bond the component, and a secondary resilient adhesive to surround and substantially contain the solder. If the temperature of the PTC reaches its Curie temperature, the solder will melt and relax any stresses due to CTE mismatch. While melted, the solder continues to serve as a thermal and electrical conductor between the ceramic disk PTC and the substrate it is mounted to. The secondary adhesive serves to capture the molten solder within the bonding area and prevent the ceramic disk component from becoming detached from the substrate. The solder will then re-freeze when the temperature drops back below the Curie temperature of the PTC, where the PTC CTE is more stable.

An immediate application of the present invention is mounting the ceramic disk PTC thermistor used in the solid ink melt heaters as a thermal safety device. As earlier noted, the present embodiments should be applicable for other component bonding applications facing CTE mismatch issues, and which would benefit from the thermal and/or electrical bond effectiveness of a soldered connection.

By "low-melting-temperature" is meant a melting temperature below the desired Curie temperature of the PTC, or in other bonding applications, low enough to minimize the CTE mismatch in the bonded system. By "high temperature adhesive" is meant an adhesive having a useable operating temperature high enough to maintain a reliable bond up to the maximum temperature the bonded system is expected to be exposed to.

As noted, the present invention will be described for use in relation to a solid ink marking system such as printers, facsimile, copiers, multifunctional machines and the like. However, the embodiments defined herein may be used in any situation where a ceramic disk PTC thermistor or other ceramic electronic component is used, where soldering would have beneficial value, but would be complicated by the CTE stresses bound-up in the joint by higher temperature soldering methods.

The novel ceramic disk PTC is used in this embodiment as the protective device in the ink melt heaters of a solid ink printer/copier system similar to the above-described marking systems.

In solid ink printing apparatus, the ceramic disk PTC of this invention provides a protective device in each of the ink melt heaters used. When attempting to attach ceramic disk PTCs to conductive heater circuits on aluminum substrates, it has been observed that conventional approaches to soldering caused cracking of the PTC due to the stresses from the dissimilar CTE of the ceramic PTC disk and an aluminum substrate. As earlier noted, PTC manufacturers have recommended that PTC devices cannot be reliably soldered in this type of application and recommend other attachment means which have other compromises, such as poorer thermal and electrical conductivity than soldering. For example, one other attachment method that has been used is conductive epoxy with a metal powder added to achieve conductivity such as silver. The disadvantages of silver epoxy are that the interface is less electrically and thermally conductive than solder, the silver epoxy is more expensive, and silver epoxy can also experience some CTE stress in the bond when used in systems that will experience temperature swings in excess of the Curie Temperature of the PTC. The reduced thermal conductivity causes the PTC to respond to thermal events more slowly and the reduced electrical conductivity causes undesirable variability in the total system electrical resistance.

The present invention described herein is just one application of the novel attachment method and structure. The ceramic disk PTC thermistor is used in this example system as a protection device as part of an ink melting heater for solid ink. The PTC in this system is chosen to have a low resistance below its Curie temperature, and is electrically placed in series with the heater resistance element. This heater system is controlled by a power control system which is designed to maintain heater temperature within desired operational limits. If any failure occurs in this power control system that would allow the heater temperature to exceed the desired upper limit temperature, the PTC attached to the heater will exceed its Curie temperature and begin to increase rapidly in resistance. As the resistance of the PTC increases, the electrical current in the heater system drops inversely to the increasing resistance, and the heater power decreases as the square of the decrease in current. By these thermal and electrical effects, the heater is protected against damage that might otherwise occur as a result of the power control system failure. In this fashion, the PTC electrically in series with the heater and thermally bonded to the heater constitutes a fail-safe heater protection system. For this heater protection system to be reliable, the ceramic disk PTC thermistor must remain reliably attached to the heater system substrate, and must retain effective thermal and electrical connections to the heater system substrate.

The duplex attachment method herein envisioned uses a low temperature solder to achieve the electrical and thermal bond to the heater, and a resilient adhesive to keep the PTC attached to the heater even when the solder is above its melting temperature. The resilient adhesive also serves to capture the solder and help prevent it from migrating out of the bond area.

In some applications, depending on the temperature ranges of the operating system and the chemical properties of the adhesive, the solder compound, and the solder flux that might be used, it may be useful to leave a small gap in the adhesive barrier to allow any out-gassing that occurs from these materials to escape. Through a combination of orientation opposite to the pull of gravity, and the natural surface tension of the liquefied solder, a small gap in the adhesive barrier may still prevent escape of the solder even when the solder is melted.

DETAILED DISCUSSION OF DRAWINGS AND PREFERRED EMBODIMENTS

Figure 1:
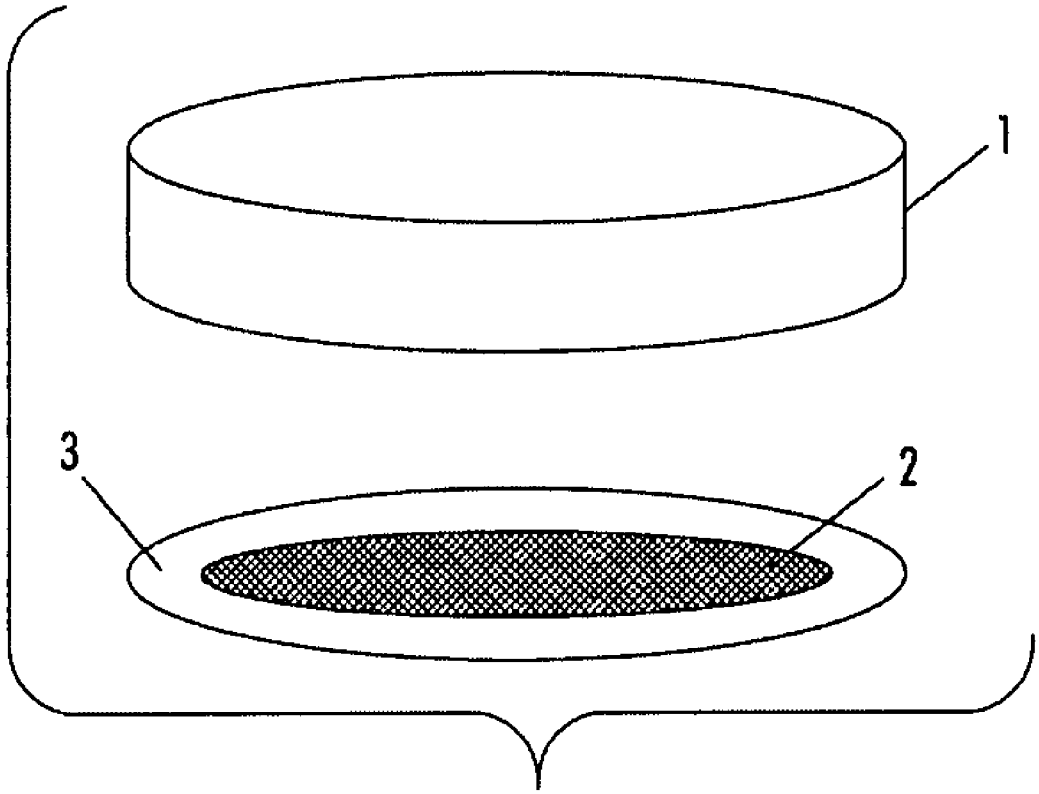
FIG. 1 is a top perspective view of an exploded view of an embodiment of the present ceramic disk PTC.
Figure 2:
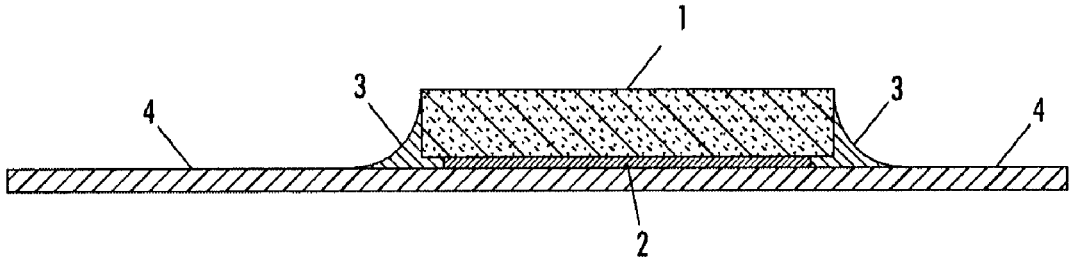
FIG. 2 is a cross-sectional side view of an embodiment of the present ceramic disk PTC connected to a typical substrate.

In FIGS. 1 and 2, analysis revealed that the ceramic disk PTC thermistor 1 goes through complex cycles of mechanical expansion and contraction as it heats and cools, particularly as it passes through the Curie temperature where its electrical resistance changes dramatically. This involves changes in the ceramic material from crystalline to amorphous structure. By using a solder 2 with a melt temperature at or below this Curie temperature, the shear stresses that would otherwise be frozen into the system can be prevented. Using a low-melting-temperature solder 2 would typically not be considered in this application because a thermal event that would trigger the PTC Curie temperature would also melt the attachment solder and allow the PTC to become detached. By using the herein described novel duplex-attachment process with low temperature solder 2 and a capturing ring of high temperature resilient adhesive 3, the solder 2 continues to function as an electrical and thermal interface even if it melts to a liquid state. When the system operates below the Curie temperature of the PTC, the low temperature solder 2 also provides a strong mechanical bond along with the adhesive 3, without the extreme shear stress that would exist if the solder was frozen above the Curie temperature of the PTC.

The solder 2 melting temperature in this example system is chosen to be 138° C., the high temperature adhesive in this example system has a useful operating temperature range well above 200° C., and the ceramic PTC 1 has a Curie temperature transition region in its R/T (resistance over temperature) curve at about 140° C. For the PTC 1, the important factor is the "knee" of the R/T curve where the resistance curve begins to get very steep, also referred to as the Curie temperature (e.g. above this temperature, small changes in temperature increase electrical resistance rapidly). The region of this curve could be thought of as the temperature where the PTC 1 begins to cut off power to the heater it is connected to. (Not shown in the drawings.)

In FIG. 2, a side view of the novel ceramic PTC of this invention is shown attached to a substrate 4. The substrate 4 provides a mechanical foundation for the heater system. The substrate 4 might be made of any suitable material, organic compounds, metals, or other materials that might be useful for the desired application. The selected materials will have specific properties such as their CTE and thermal conductivity which will affect their suitability to any particular application. The example solid ink heater application employs an aluminum substrate. The adhesive 3 at least substantially encloses the solder 2 (illustrated is complete enclosure). The important feature of adhesive 3 is that it prevents the molten solder 2 from escaping the region of said solder bond area.

Figure 3:
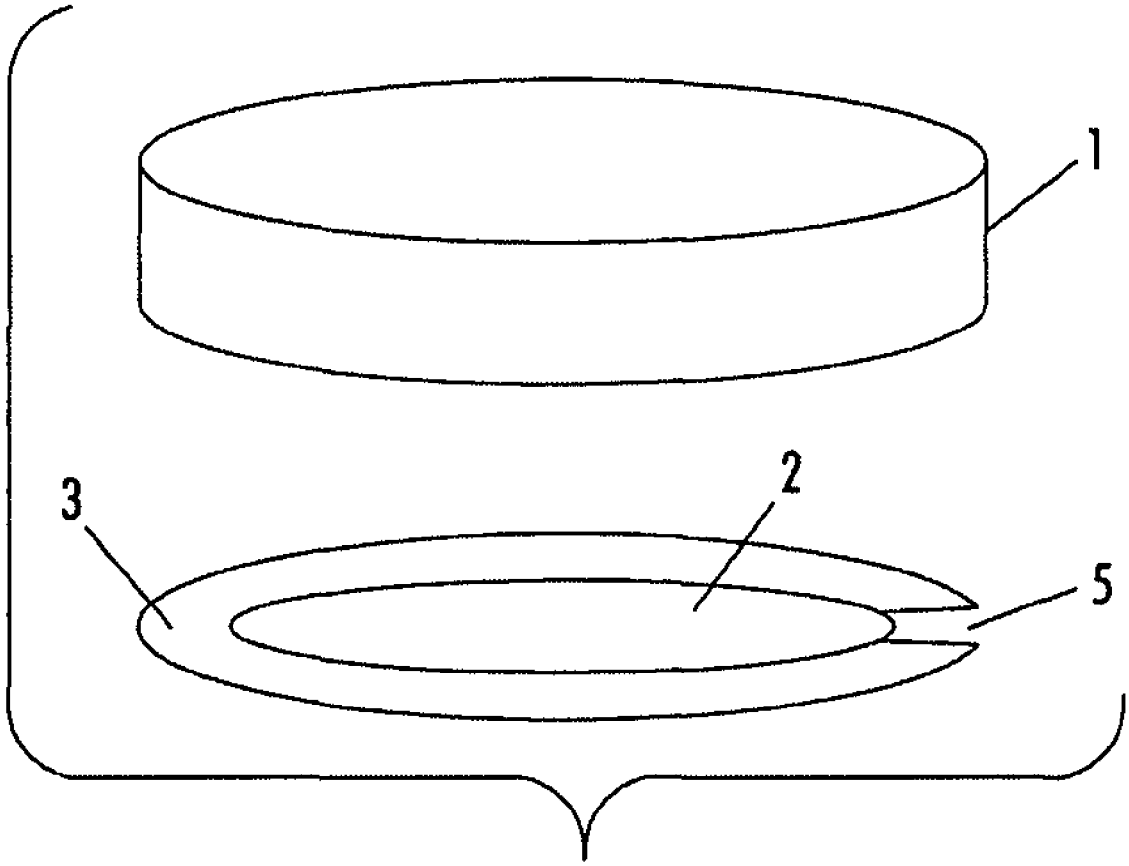
FIG. 3 is a top perspective view of an exploded view of an embodiment where the adhesive does not completely surround the solder.

Any suitable solder 2 and adhesive 3 may be used. The adhesive used in the example application needs to be fully functional with the heaters used in the solid ink printing apparatus in one embodiment. In other uses, for the present ceramic disk PTC, proper adhesives and solders of the present disk can be determined by experimentation. The actual size of the solder pad is not critical to the present embodiment, it could be smaller than the diameter of the PTC, or larger, depending on the needs of the adhesive bond, and the thermal and electrical effects of different sized solder pads. In some embodiments such as that shown in FIG. 3, the adhesive 3 need not encircle the entire periphery or outer portion of the solder 2 provided the adhesive 3 prevents most if not all of the molten solder 2 from escaping the region or contact are of the bond. The adhesive 3 surrounding the solder 2 surrounds the solder to a degree sufficient to prevent substantial escape of molten solder 2 from the contact area. Only a small open space 5 is provided in adhesive 3.

An adhesive material 3 might be chosen to be low enough viscosity that it will wick into a gap under the edge of the attached PTC after solder reflow, or a thicker viscosity adhesive might be used by applying a ring of this adhesive before attachment of the PTC.

Trapped air within the bond should be avoided as it would create additional stress on the joint as it expands with temperature. Trapped air also reduces the thermal interface efficiency which is needed. Microscopically small amounts of trapped air are not expected to be a serious problem, and a small gap in the adhesive described above may prove useful to allow venting of trapped air or out-gassing of the various components in the system.

In small heater uses, it could be useful to employ a small solder pad 2 to attach the PTC 1, as described above, so that the heater traces can consume more of the total heater area thereby reducing the watt-density of the heater element traces making the heater more robust against damage during the beginning stages of a power control system failure before the PTC 1 has cut off power to the heater sufficiently to protect it. In this design, it is envisioned using a much wider donut of adhesive 3. This might require a pre-printing of the adhesive 3 donut with a silk screening process, similar to what is used to apply solder paste, before attaching the PTC 1. This envisioned larger adhesive area and reduced solder bond area may require that the adhesive exhibit high thermal conductivity. These adhesive 3 and solder 2 application techniques are standard industry art uniquely applied in combination for the purpose of this disclosure.

Figure 4:
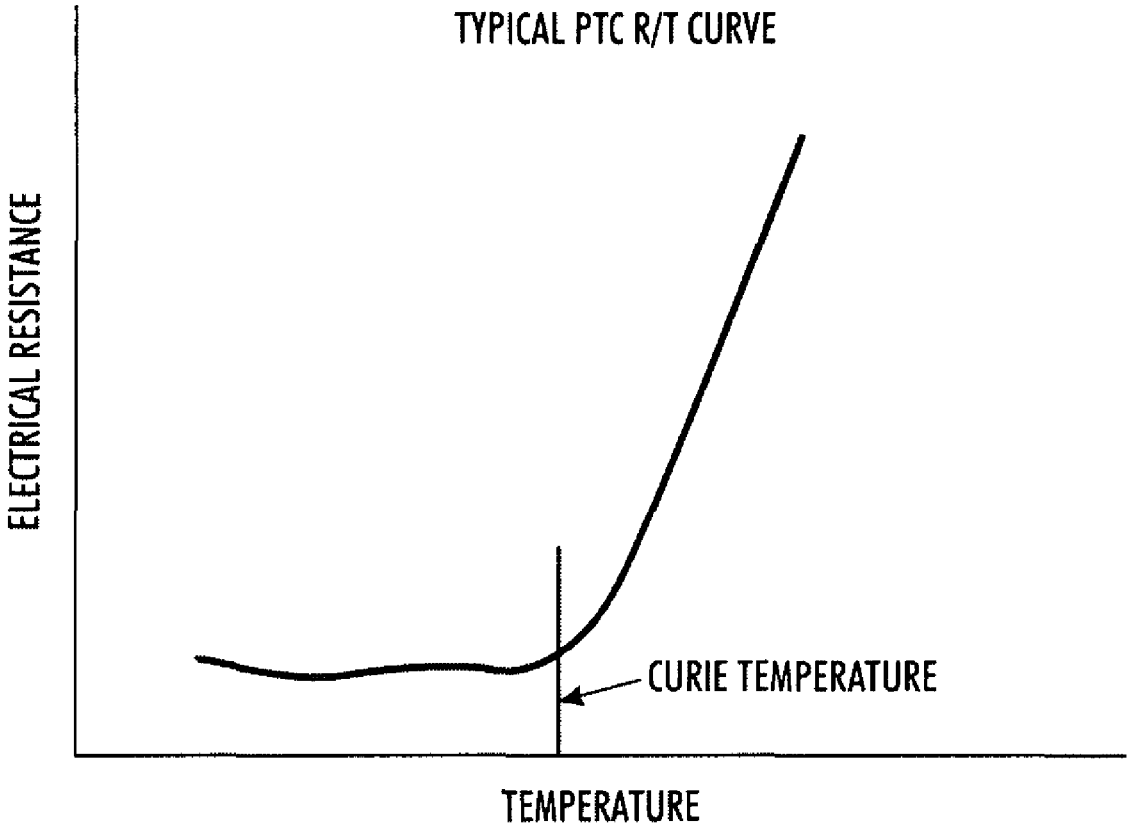
FIG. 4 is a representative PTC R/T curve drawing to further clarify the present invention.

In FIG. 4 a graph is shown where the PTC (positive temperature coefficient ([of resistance]) thermistors are electrical components whose primary feature is that their resistance increases in a controlled fashion as the temperature increases above some threshold. A plotted graph of a PTC's resistance and temperature is commonly referred to as an R/T curve, and is shown in FIG. 4. The threshold temperature above which the PTC's resistance increases rapidly is referred to as the Currie Temperature, and exhibits a distinctive transition in the PTC's R/T curve. Before the Currie Temperature, the resistance may be unchanging, or even decline very slightly, but as the Curie temperature is exceeded, the slope of increasing resistance typically becomes very steep. For clarity it should be noted that a key characteristic is a curve that is substantially flat with some waviness before the Curie temperature, and a steeply sloped line to the right of the Curie Temperature (shown in FIG. 4).

In summary, in an embodiment of this invention provided is a ceramic disk PTC assembly comprising in an operative arrangement a ceramic disk, a low-melting temperature solder, and a high-operating temperature adhesive. The solder is enabled to attach said disk to a substrate and thereby provide a strong mechanical bond of said disk to said substrate. There is a high-operating-temperature adhesive encircling or substantially encircling all of said solder. The solder is enabled to function as an electrical and thermal interface whether it is in the frozen solid or melted liquid form, and the solder and said adhesive operate in complementary fashion and are enabled to provide a strong mechanical bond to said substrate through a wide range of temperatures.

The solder is enabled to transition from frozen solid state to a liquid melted state at a melt temperature chosen to be at or below the Curie temperature of the ceramic disk PTC required by a given application. The melt temperature allows the solder to become liquid during the CTE changes to the PTC that occur above the Curie temperature of the PTC The liquid solder is enabled to minimize CTE-induced shear and other mechanical stresses. The resilient adhesive has a useful operating temperature substantially above the temperature where said solder transitions from frozen solid state to melted liquid state. It is substantially above the expected maximum operating temperature range of the application system, and has a resilience sufficient to absorb the shearing and other stresses imposed by the differential CTE properties of the bonded elements. The assembly of this invention is adapted for use as a member selected from the group consisting of a heating element, a temperature sensor, a protection device against over current and mixtures thereof.

A use for this invention is in a solid ink melting system useful in solid ink marking apparatus. This system comprising a ceramic disk PTC assembly, this assembly comprising in an operative arrangement a ceramic disk PTC, a low-melting-temperature solder and a high-operating temperature adhesive. The solder is enabled to attach said disk to a substrate and thereby provide a strong mechanical bond to said substrate. The high-operating-temperature adhesive is at least substantially encircling said solder and wherein said solder has a smaller diameter than an outside diameter of said disk. Also, said adhesive is provided around a perimeter of said disk and said solder, the adhesive surrounding solder to a degree sufficient to substantially prevent escape of molten solder from the attachment area. The solder is enabled to function as an electrical and thermal interface whether it is in the frozen solid state or melted liquid state. The chose properties of the solder and the adhesive are enabled to operate in complementary fashion to provide a strong mechanical bond to the substrate across a wide range of temperatures.

The solder has a melting temperature, which is below the temperature where excessive CTE stresses might cause damage to components, or cause a failure of the bond between the component and the substrate. A pattern of low-melting-temperature solder and resilient adhesive are enabled to employ other shapes and/or be divided up into multiple segments for purposes selected from the group consisting of easier printing, for distributing the CTE stresses differently, and for any other purpose. It is enabled to employ a two-part attachment structure and method where one part or material is a low-melting-temperature solder, and the other part is a higher operating temperature resilient adhesive that is enabled to retain said bond even when the temperature rises above a melting temperature of the solder, and the substrate is constructed of aluminum. The substrate may be constructed of a material, said material has a CTE that does not match the device being attached to it. Thus, the assembly is enabled to will benefit from the duplex attachment method herein described. The adhesive at least substantially encloses said solder and is enabled to substantially capture and retain said solder when in a melted liquid state and prevent said solder from escaping an adhesive barrier. The present assembly is adapted for use as a member selected from the group consisting of a heating element, a temperature sensor, a protection device against over-power and mixtures thereof. As earlier noted, the solder is enabled to be melted and subsequently re-solidified without losing its beneficial electrical and thermal conductivity.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims:

What is claimed is:

1. A solid ink development system useful in solid ink marking apparatus, said system comprising a ceramic disk PTC assembly, said assembly comprising in an operative arrangement, a ceramic disk PTC, a low-melting-temperature solder, and a high-operating-temperature adhesive, said solder enabled to attach said disk to a substrate and thereby provide a strong mechanical bond and attachment to said substrate, said high-operating-temperature adhesive at least substantially encircling said solder, and wherein said solder has a smaller diameter than an outside diameter of said disk, and said adhesive provided around a perimeter of said disk and said solder, said adhesive surrounding said solder to a degree sufficient to substantially prevent substantial escape of molten solder from said attachment area.

2. The system of claim 1 whereby said solder is enabled to function as an electrical and thermal interface whether it is in the frozen solid state or melted liquid state.

3. The system of claim 1 whereby the chosen properties of said solder and said adhesive are enabled to operate in complementary fashion to provide a strong mechanical bond to said substrate across a wide range of temperatures.

4. The system of claim 1 whereby said solder has a melting temperature which is below the temperature where excessive CTE stresses might cause damage to components, or cause a failure of the of the said bond between the component and the substrate.

5. The system of claim 1 whereby said adhesive has a useful operating temperature substantially above the melting temperature of said solder, and substantially above the maximum temperature that the said system might be exposed to.

6. The system of claim 1 whereby a pattern of low-melting-temperature solder and resilient adhesive are enabled to employ other shapes and/or be divided up into multiple segments for purposes selected from the group consisting of easier printing, for distributing the CTE stresses differently, and for any other purpose, and is enabled to employ a two-part attachment structure and method where one part or material is a low-melting-temperature solder, and the other part is a higher operating temperature resilient adhesive that is enabled to retain said bond even when the temperature rises above a melting temperature of the solder, said adhesive surrounding said solder to a degree sufficient to prevent substantial escape of molten solder from bond area.

7. The system of claim 1 whereby said substrate is constructed of aluminum.

8. The system of claim 1 whereby the substrate may be constructed of a material, said material has a CTE that does not match the device being attached to it, such that the assembly is enabled to will benefit from the duplex attachment method herein described.

9. The system of claim 1 whereby said adhesive at least substantially encloses said solder and is enabled to capture and retain said solder when in a melted liquid state and prevent said solder from escaping an adhesive barrier.

10. The system of claim 1 whereby said assembly is adapted for use as a member selected from the group consisting of a heating element, a temperature sensor, a protection device against over-power and mixtures thereof.

11. The assembly of claim 1 whereby said solder is enabled to be melted and subsequently re-solidified without losing its beneficial electrical and thermal conductivity.

* * * * *